US007140053B1

(12) United States Patent
Mangano

(10) Patent No.: US 7,140,053 B1
(45) Date of Patent: Nov. 28, 2006

(54) COMBINATION FLAT SHEET, FITTED SHEET AND BED SKIRT

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 11/221,262

(22) Filed: Sep. 7, 2005

(51) Int. Cl.
*A47G 9/02* (2006.01)

(52) U.S. Cl. ..... 5/493; 5/500; 5/482; 5/502

(58) Field of Classification Search ..... 5/493, 5/500, 497, 482, 495, 502
See application file for complete search history.

(56) References Cited

U.S. PATENT DOCUMENTS

| | | | | | |
|---|---|---|---|---|---|
| 2,641,001 | A | * | 6/1953 | Krasnov | 5/499 |
| 3,962,739 | A | | 6/1976 | Crockett | |
| 4,035,854 | A | | 7/1977 | Pardee | |
| 4,386,439 | A | * | 6/1983 | Roccograndi et al. | 5/498 |
| 4,734,947 | A | | 4/1988 | Vitale | |
| 5,063,626 | A | * | 11/1991 | Carlos | 5/493 |
| 5,335,383 | A | | 8/1994 | Schwind | |
| 5,638,562 | A | | 6/1997 | Masoncup | |
| 6,044,503 | A | | 4/2000 | McClendon | |
| 6,061,851 | A | | 5/2000 | Crowell | |
| 6,119,290 | A | | 9/2000 | Masoncup | |
| 6,886,197 | B1 | | 5/2005 | Madigan | |
| 6,971,129 | B1 | * | 12/2005 | Wootten et al. | 5/493 |
| 2004/0226089 | A1 | | 11/2004 | Miranda | |

* cited by examiner

*Primary Examiner*—Alexander Grosz
(74) *Attorney, Agent, or Firm*—Thomas M. Galgano, Esq.; Galgano & Associates, PLLC

(57) ABSTRACT

A combination flat sheet, fitted sheet and bed skirt includes a fitted sheet having a top and four sides, each side having a lower edge, the four lower edges being provided with an elastic band, the fitted sheet dimensioned to fit over a mattress supported by a box spring. The bed skirt is attached only to the left, right and foot peripheral edge of the top of the fitted sheet and extends downward in sufficient length to cover the left, right and foot sides of the fitted sheet and the left, right and foot sides of the box spring. The flat sheet is attached only to the foot edge of the top of the fitted sheet and is dimensioned such that its left, right and foot flaps extend downward in sufficient length approximately to or just beyond the box spring. The length of the flat sheet in the head direction is of sufficient length such that the sheet can be folded over itself at the head of the bed.

6 Claims, 5 Drawing Sheets

A
B
10
12
16
20
24
28
30
32
35
37
40
42
44
52
54
7
7'
8
8'

COMBINATION FLAT SHEET, FITTED SHEET AND BED SKIRT

BACKGROUND OF THE INVENTION

1. Field of the Invention

This invention relates broadly to bedclothes. More particularly, this invention relates to a combination flat sheet, fitted sheet and bed skirt which are attached to each other in a specific manner to simplify bed making and to provide an aesthetically pleasing arrangement of bed clothes.

2. State of the Art

Various specific types and designs of bedclothes, commonly including various coverings (as sheets, comforters, bed skirts, pillow cases) used on a bed, are well known to those skilled in the art. However, to make a bed using typical bedclothes, each separate piece is put on the bed one at a time.

It is also well known that bedclothes are not merely functional, much attention has been given to the aesthetic value of bedclothes. Bedclothes featuring a variety of aesthetic themes are widely available.

U.S. Pat. No. 6,044,503 to McClendon discloses a combination flat sheet, fitted sheet and bed skirt. The fitted sheet, like most known fitted sheets includes a top, four sides and a bottom edge of elastic which runs along the edge of all four sides. When the fitted sheet is placed over a mattress, the elastic edge resides between the bottom of the mattress and the box spring supporting the mattress. The different sides of the fitted sheet can be referred to as right, left, head and foot. According to the '503 patent, the bed skirt or dust ruffle has a foot side, left side and right side which are respectively connected to the bottom edge of the left, right and foot sides of the fitted sheet. The flat sheet has right, left, head and foot edges. According to the '503 patent, the flat sheet is dimensioned so that its left and right edges are substantially coextensive with the left and right edges of the fitted sheet, i.e., then extend substantially to the interface between the box spring and the mattress, and the foot edge is connected to the bottom foot edge of the fitted sheet.

While the '503 patent provides bedclothes for making a bed in an efficient, timesaving manner, it has several aesthetic drawbacks. The way the pieces are connected, attention is drawn to the interface between the box spring and the mattress, and many of the connecting stitches are visible.

SUMMARY OF THE INVENTION

It is therefore an object of the invention to provide a combination flat sheet, fitted sheet and bed skirt which are attached to each other in various places to simplify bed making.

It is another object of the invention to provide a combination flat sheet, fitted sheet and bed skirt which are attached to each other in various places to provide an aesthetically pleasing arrangement of bed clothes.

It is a further object of the invention to provide a bed fashion set including a combination flat sheet, fitted sheet and bed skirt together with other bedding accessories.

Certain of the foregoing and related objects are attained according to the invention in a combination flat sheet, fitted sheet and bed skirt for use with a rectangular mattress supported by a rectangular box spring, each of said mattress and box spring having a top and four sides including a head, a foot, left side and a right side, comprising: a fitted sheet defining a top panel and four side panels which side panels, when fitted on the mattress, depend from said top panel to define a head panel, a left side panel, a right side panel and a foot panel, said top panel being bounded by a peripheral edge defining a left side edge, a right side edge, a head edge, and a foot edge by which it merges with said left side panel, right side panel, head panel and foot panel of said side panels, respectively each of said side panels having a lower edge, said lower edges being provided with an elastic band: a bed skirt attached generally along and adjacent to only to the left side edge, right side edge and foot side edge of said top panel of said fitted sheet and extending downward in sufficient length to cover the left side, right side and foot side of said fitted sheet and the left, right and foot sides of the box spring; and a flat sheet attached to said fitted sheet generally along and adjacent to only said foot edge thereof.

Preferably, the said flat sheet is dimensioned such that it defines, when placed on the mattress, a top panel and downwardly depending left, right and foot side flaps that extend downward in sufficient length approximately to the bottom of the mattress. Desirably, the length of said flat sheet in the head direction is sufficient that the sheet can be folded over itself adjacent to the head of the bed.

Certain of the foregoing and related objects are also attained in a bed skirt for use with a mattress and a box spring, comprising: a bed skirt comprising a sheet of fabric cut in length to fit around only three sides of the mattress and box spring and cut in width to cover both the mattress and the box spring substantially from the top of the mattress to the bottom of the box spring.

The bed skirt preferably comprises a fitted sheet defining a top, four sides and an elasticized lower edge, the fitted sheet being dimensioned to fit over the mattress with the elasticized edge tucked in and lying between the mattress and the box spring, and wherein the top panel of the fitted sheet defines a peripheral edge comprised of a head edge, left side edge, right side edge and foot edge and wherein said bed skirt is attached to said fitted sheet generally along and adjacent to only the left side, right side and foot edges of the top panel of said fitted sheet. Most advantageously, the bedskirt further comprises a flat sheet attached to said fitted sheet generally along and adjacent to only said foot edge thereof. Most desirably, the flat sheet is cut to define left, right and foot flaps.

Certain of the foregoing and related objects are attained in a bedclothes kit for use with a mattress supported by a rectangular box spring having a head side, left side, right side, and foot side, said kit comprising: a combination flat sheet, fitted sheet and bed skirt, including a fitted sheet having a top and four sides including a head side, left side, right side and foot side, each side having a lower edge, said lower edges being provided with an elastic band, said top having a peripheral edge bounded by a left side edge, right side edge, foot edge, and head edge; a bed skirt attached generally along and adjacent to only the left, right and foot peripheral edges of said top of said fitted sheet and extending downward in sufficient length to cover only said left, right and foot sides of said fitted sheet and the left, right and foot sides of the box spring; and a flat sheet attached to only said fitted sheet generally along adjacent to said foot edge thereof; a duvet in a duvet cover: at least one pillow in pillow case; at least one sham; and at least one body pillow in a body pillow cover.

Additional objects and advantages of the invention will become apparent to those skilled in the art upon reference to the detailed description taken in conjunction with the provided figures.

BRIEF DESCRIPTION OF THE DRAWINGS

FIGS. 4A and 4B are enlarged views of the encircled portions of FIG. 4.

DETAILED DESCRIPTION

Figure 1:
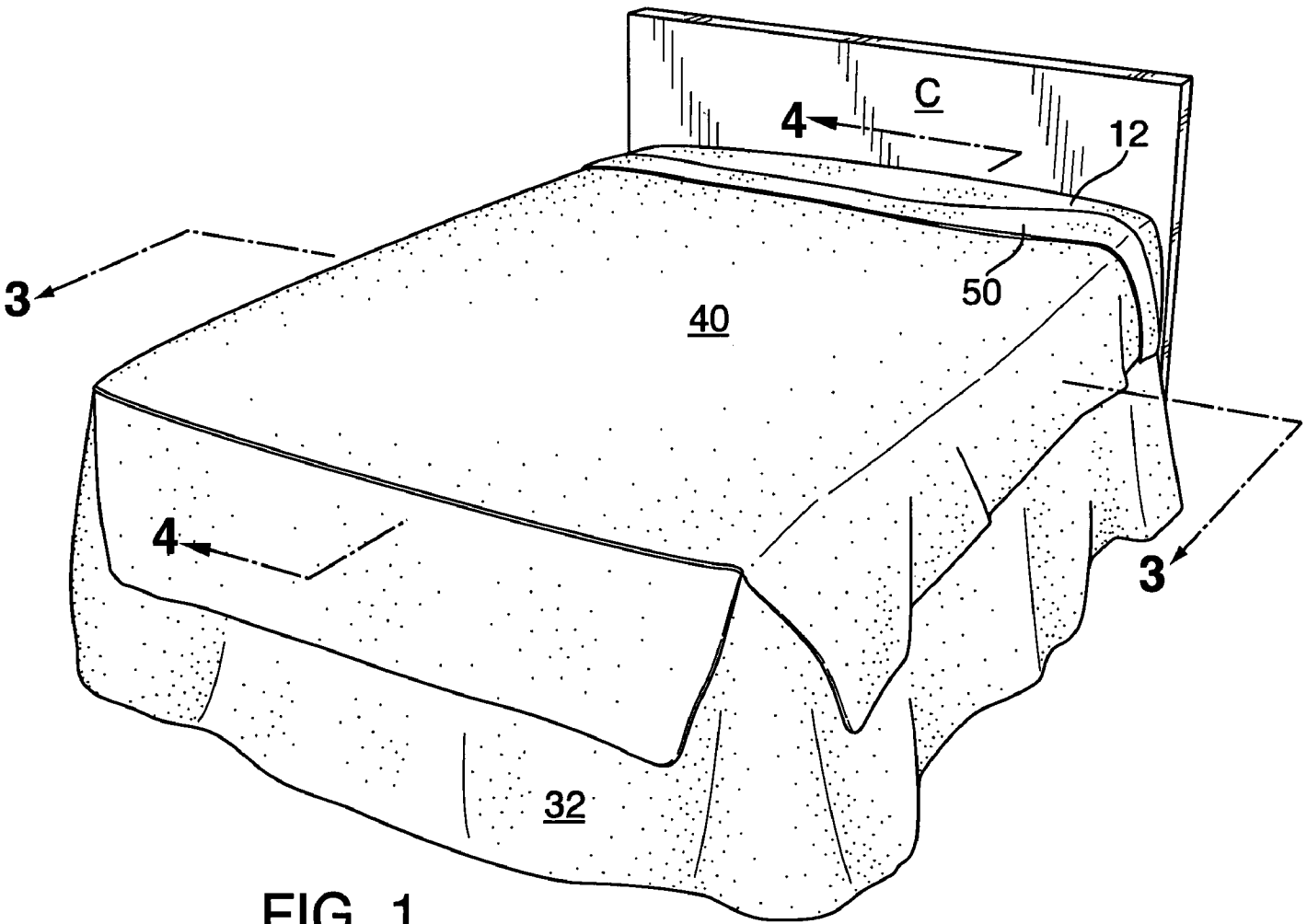
FIG. 1 is a perspective view of a combination fitted sheet, flat sheet and bed skirt according to the invention installed on a bed having a headboard.

Turning now to FIGS. 1–4, therein illustrated is a novel bed sheet assembly embodying the present invention which comprises a combination flat sheet, fitted sheet and bed skirt for use in connection with a generally rectangular mattress A and box spring B. As defined herein, mattress A and box spring B each have a top or top panel 5, 5', a head or head side 6, 6' adjacent to headboard C, a left side 7, 7' (when viewed facing the headboard), a right side 8, 8' and a foot or foot side 9, 9'; the same or similar designations will be used when discussing comparable or matching portions of the bed sheets of the invention.

The novel bed sheet assembly includes a fitted sheet 10 which, when fitted on mattress A, defines a top or top panel 12 and four depending sides or side panels-namely a head panel 14, a left side panel 16, a foot panel 18, and a right side panel 20, which drape, respectively, over the head 6, foot, left side 7, right side 8 and head 9 of the mattress A. Each side panel 14, 16, 18, 20 has a lower edge 22, 24, 26, 28, respectively, provided with one or more elastic bands 30 which draw the edges 22, 24, 26, 28 inwardly so that they are sandwiched and tucked in and secured between mattress A and box spring B. The rectangular top panel 12 of fitted sheet 10 defines a rectangular periphery bounded by peripheral edges or fold lines, including head edge 34, a left side edge 35, foot edge 36 and right side edge 37 by which it merges with the side panels 14, 16, 18, and 20, respectively.

A bed skirt 32 is attached to the fitted sheet 10 generally along and adjacent to only the left, foot, and right peripheral edges 35, 36 and 37, respectively, of the top 12 of the fitted sheet 10, preferably along stitched seams 52, 38, 54. The skirt 32 extends downward in sufficient length to cover the left, foot and right sides 16, 18, and 20, respectively, of the fitted sheet 10 and the left side 7', right side 8', and foot side 9' of box spring B.

Figure 4:
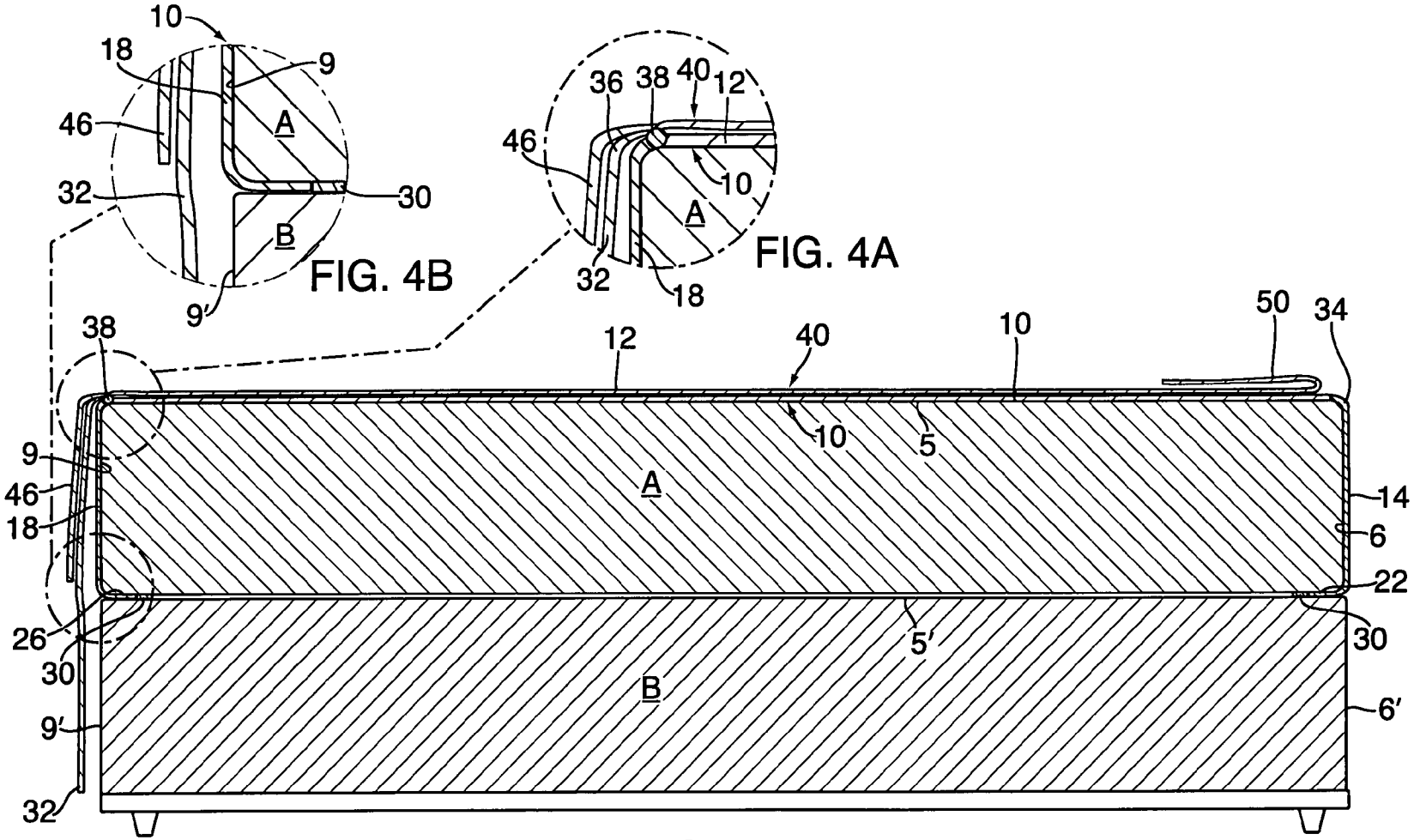
FIG. 4 is a sectional view taken along line 4—4 in FIG. 1.

As seen best in FIGS. 4, 4A and 4B, a flat or top sheet 40 is attached only to the fitted sheet 10 generally along stitched seam 38 adjacent peripheral edge 36 of top 12 thereof (which is located near the top corner of the foot of the mattress A). Top sheet 40 is dimensioned such that when it is draped over the bed, it defines a top panel 41 and three side flaps including a left flap 42, a right flap 44 and a foot flap 46, respectively, which extend downward in sufficient length approximately to the bottom of mattress A. The length of the flat sheet 40 in the head direction is sufficient that the sheet 40 can be folded over itself to provide a folded portion 50 adjacent to the head of the bed.

The stitched seams 52, 38, 54, are preferably provided with decorative piping. As seen best in FIG. 5, the bedskirt is preferably pleated to define panels 58, 60, 62, 64, and 66 which are also decorated with piping 68, 70, 72, 74, and 76, respectively.

Figure 5:
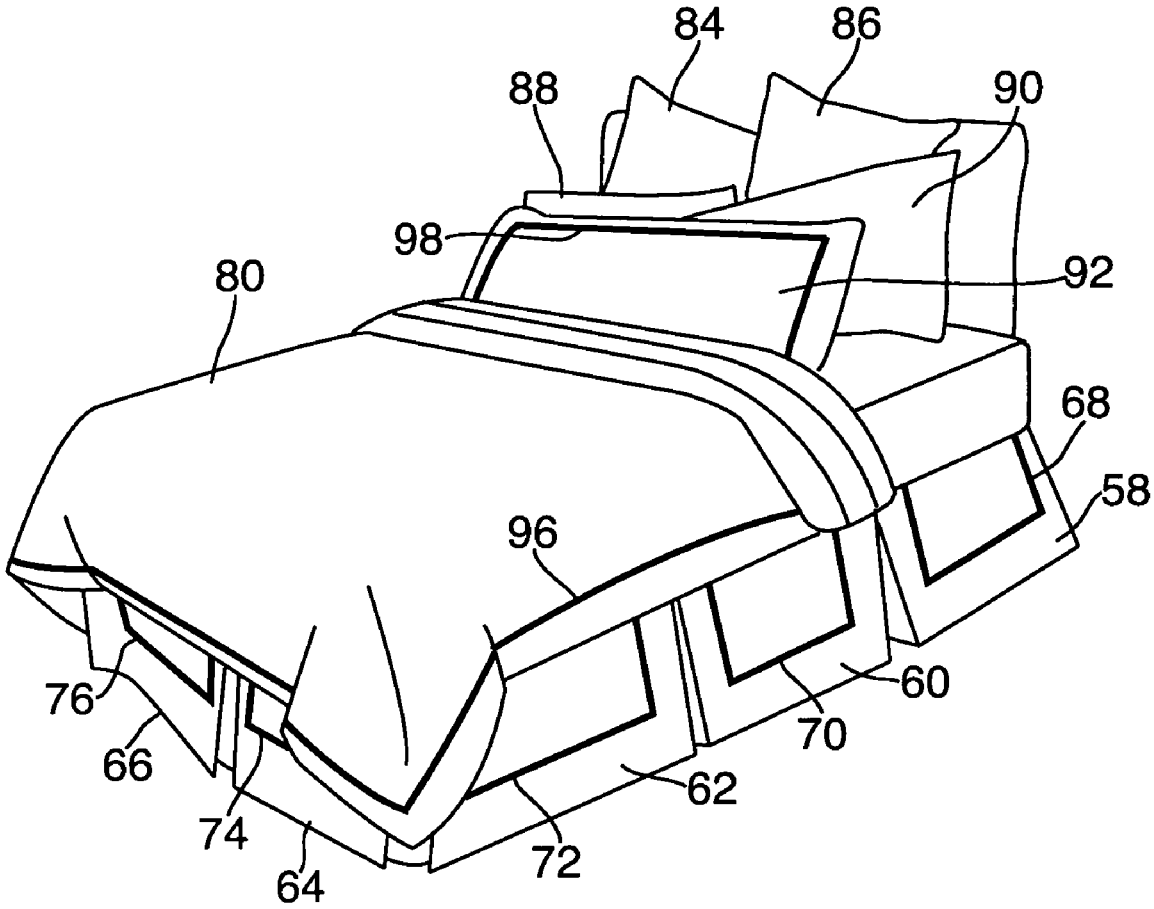
FIG. 5 is a perspective view of a bed fashion set according to the invention.

FIG. 5 illustrates a bed fashion set according to the invention. The set includes the combination fitted sheet, flat sheet and bed skirt described above plus a duvet sheathed in a duvet cover 80, two pillows sheathed in pillowcases 84, 86, two Euro-style shams 88, 90, and a body pillow received in a body pillow cover 92. The covers, cases and shams preferably match the sheets and skirt with matching decorative piping 96, 98.

To make the bed with the bed sheet assembly, one would begin by placing the fitted sheet 10 around the mattress starting at the head of the bed. The bed skirt 32 would then fall straight down into place. The top sheet 40 would then be pulled up toward the head of the bed and folded back to produce the folded portion 50 adjacent the head of the bed and the pillows and the pillows and shams would be placed atop the sheets as desired. To remove the bed sheet assembly, one would simply remove the fitted sheet 10 which, in effect, removes the fitted sheet 10, top sheet 40 and bed skirt 32 in one easy, time saving step.

Figure 2:
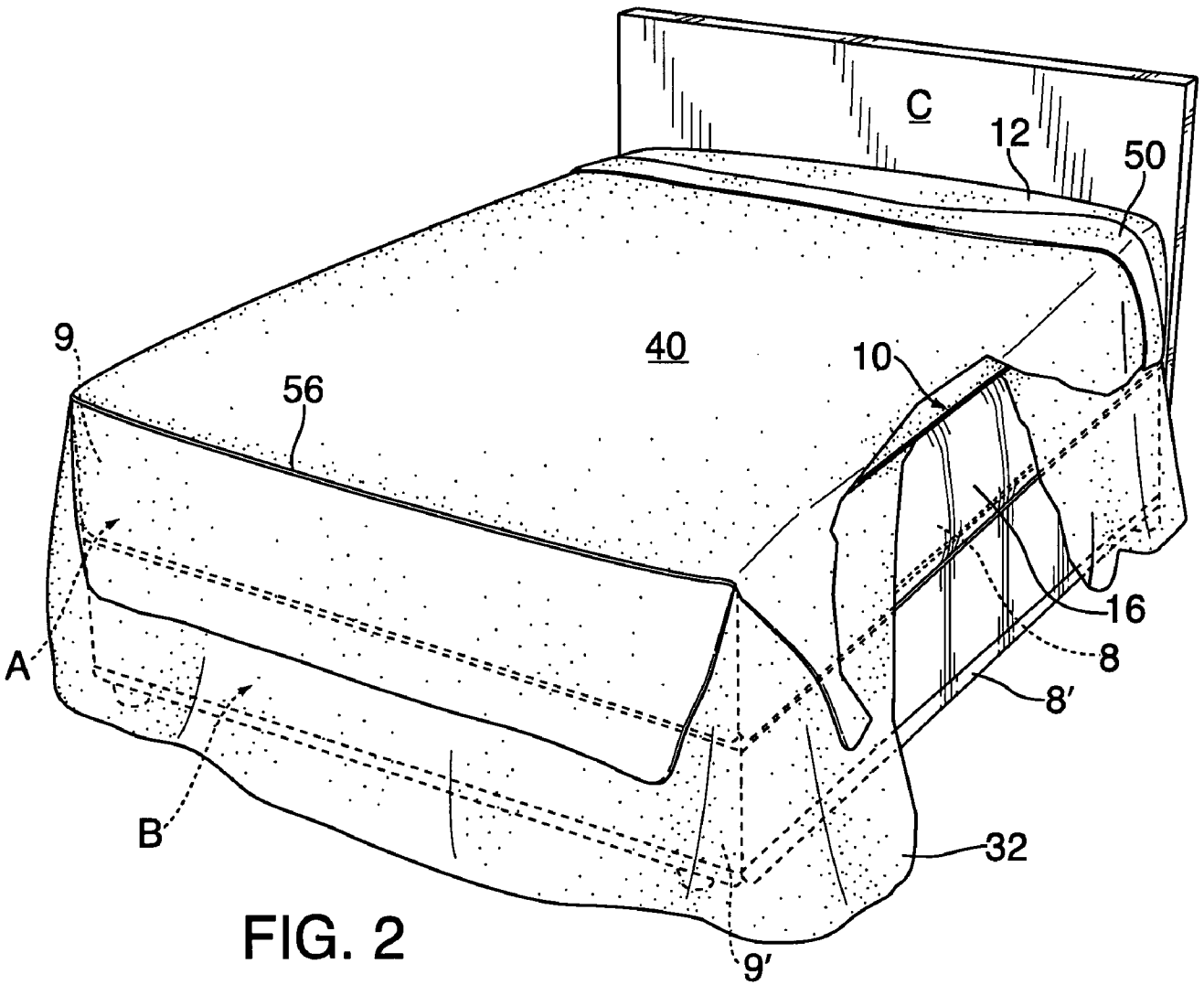
FIG. 2 is a perspective view similar to that of FIG. 1, but with a portion of the bed sheets cut away to show the manner in which they are arranged.
Figures 3, 3A, 3B:
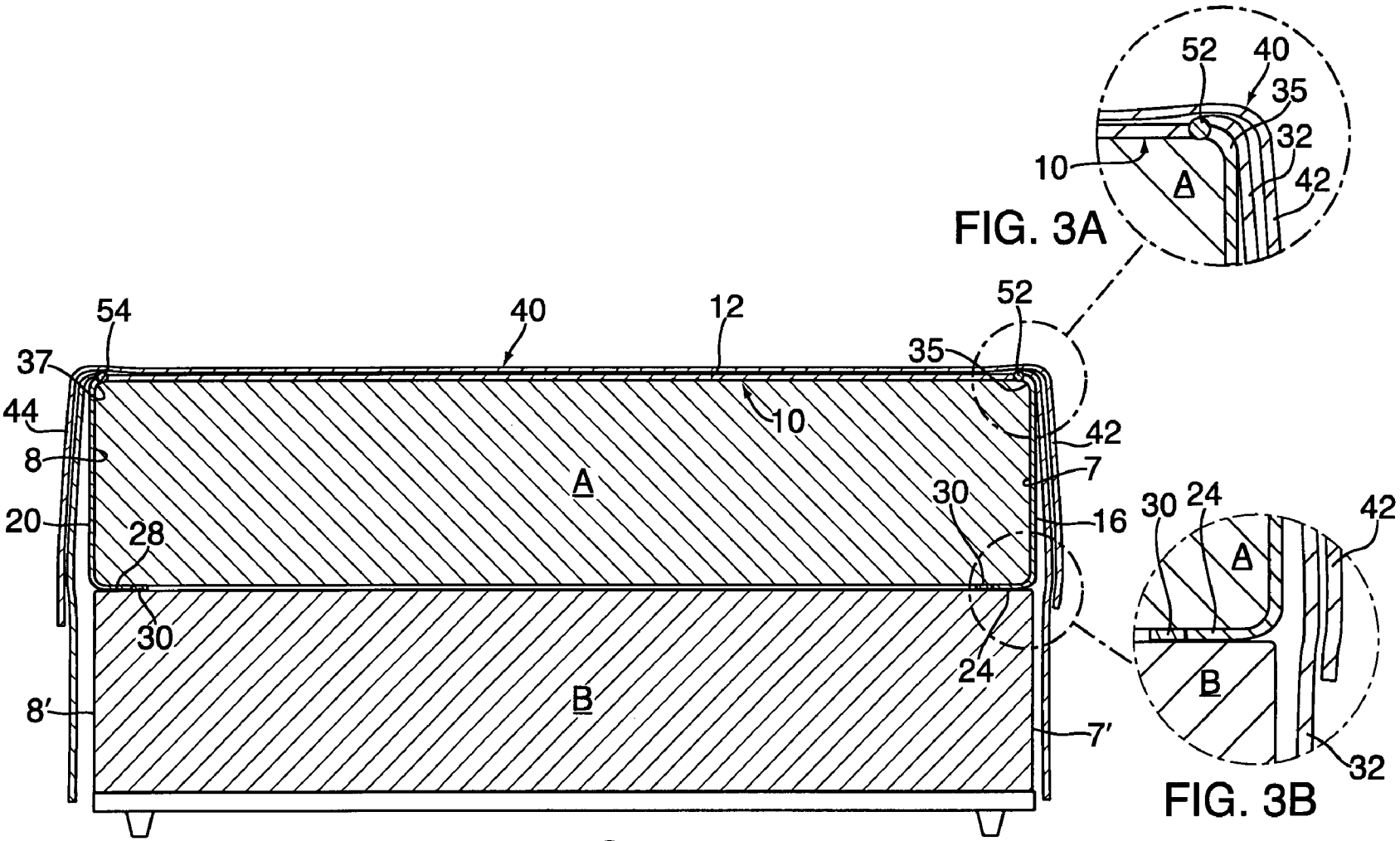
FIG. 3 is a sectional view taken along line 3—3 in FIG. 1.
FIGS. 3A and 3B are enlarged views of the encircled portions of FIG. 3.

One of the key preferred features of the invention is that bed skirt 32 extends from the top of mattress A to the bottom of box spring B, thus concealing the interface between mattress A and the box spring B. Prior art bed skirts extend from the top of the box spring down, thereby calling attention to the interface between the mattress and the box spring. As shown in FIGS. 1 and 2, another preferred feature of the invention is that the flat sheet is cut to remove two square pieces from the two bottom corners adjacent the foot of the bed. This provides a flap look in which the corners of the flat sheet 40 at the foot of the bed expose the long bed skirt 32 giving a rich, plush look to the bedding.

Throughout the description of the invention, various dimensions have been made with reference to the size of a mattress and box spring. Those skilled in the art will appreciate that beds are made in a variety of sizes, but several standard sizes are well known, e.g. twin, double, queen, and king. Thus, when a dimension is referred to in relationship to the bed, mattress, or box spring, it refers to any one of the standard bed sizes. As such, the bedclothes of the invention are manufactured in different sizes to fit standard bed sizes. Moreover, while it is preferred that the flat sheet, fitted sheet and bed skirt are permanently attached to one another by sewing or stitching, they could be releasably attached to one another by Velcro fasteners, snap buttons, zippers or the like. As used herein, the phrase "generally along" is intended to cover either continuous or intermittent or spaced stitching, or the use of spaced-apart releasable fasteners as described above. In addition, the length of the various components of the inventive assembly can be modified to suit a particular application. Furthermore, various fabric materials and designs may be employed with the inventive assembly.

There have been described and illustrated herein a combination flat sheet, fitted sheet and bed skirt. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A combination flat sheet, fitted sheet and bed skirt for use with a rectangular mattress supported by a rectangular box spring, each of said mattress and box spring having a top and four sides including a head, a foot, left side and a right side, comprising:

a fitted sheet defining a top panel and four side panels which side panels, when fitted on the mattress, depend from said top panel to define a head panel, a left side panel, a right side panel and a foot panel, said top panel being bounded by a peripheral edge defining a left side edge, a right side edge, a head edge, and a foot edge by which it merges with said left side panel, right side panel, head panel and foot panel of said side panels, respectively, each of said side panels having a lower edge, said lower edges being provided with an elastic band;

a bed skirt attached generally along and adjacent to only to the left side edge, right side edge and foot edge of said top panel of said fitted sheet and extending downward in sufficient length to cover the left side, right side and foot side of said fitted sheet and the left, right and foot sides of the box spring; and a flat sheet attached to said fitted sheet generally along and adjacent to only said foot edge thereof and wherein said flat sheet, fitted sheet and bed skirt are attached together via attachment means including a stitched seam along said foot edge of said top panel of said fitted sheet.

2. The combination according to claim 1, wherein:

said flat sheet is dimensioned such that it defines, when placed on the mattress, a top panel and downwardly depending left, right and foot side flaps that extend downward in sufficient length approximately to the bottom of the mattress.

3. The combination according to claim 2, wherein:

the length of said flat sheet in the head direction is sufficient that the sheet can be folded over itself adjacent to the head of the bed.

4. The combination according to claim 1, wherein said attachment means solely comprises said stitched seam.

5. A bedclothes kit for use with a mattress supported by a rectangular box spring having a head side, left side, right side, and foot side, said kit comprising:

a combination flat sheet, fitted sheet and bed skirt, including a fitted sheet having a top and four sides including a head side, left side, right side and foot side, each side having a lower edge, said lower edges being provided with an elastic band, said top having a peripheral edge bounded by a left side edge, right side edge, foot edge, and head edge;

a bed skirt attached generally along and adjacent to only the left, right and foot peripheral edges of said top of said fitted sheet and extending downward in sufficient length to cover only said left, right and foot sides of said fitted sheet and the left, right and foot sides of the box spring; and a flat sheet attached to said fitted sheet generally along adjacent to only said foot edge thereof;

a duvet in a duvet cover;

at least one pillow in a pillow case;

at least one sham; and at least one body pillow in a body pillow cover, wherein said flat sheet, fitted sheet and bed skirt are attached together via attachment means including a stitched seam along said foot edge of said top panel of said fitted sheets.

6. The bedclothes kit according to claim 5, wherein said attachment means solely comprises said stitched seam.

* * * * *